US010898996B2

(12) United States Patent
Heeb et al.

(10) Patent No.: US 10,898,996 B2
(45) Date of Patent: Jan. 26, 2021

(54) COMBUSTION-POWERED PLACING TOOL AND METHOD FOR OPERATING SUCH A PLACING TOOL

(71) Applicant: Hilti Aktiengesellschaft, Schaan (LI)

(72) Inventors: Norbert Heeb, Buchs (CH); Peter Bruggmueller, Bludesch (AT); Dominik Schmidt, Buchs (CH); Tilo Dittrich, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 88 days.

(21) Appl. No.: 16/062,351

(22) PCT Filed: Dec. 20, 2016

(86) PCT No.: PCT/EP2016/081852
§ 371 (c)(1),
(2) Date: Jun. 14, 2018

(87) PCT Pub. No.: WO2017/108745
PCT Pub. Date: Jun. 29, 2017

(65) Prior Publication Data

US 2018/0370005 A1 Dec. 27, 2018

(30) Foreign Application Priority Data

Dec. 22, 2015 (EP) ..... 15201888

(51) Int. Cl.
*B25C 1/08* (2006.01)
*F02B 1/04* (2006.01)
(Continued)

(52) U.S. Cl.
CPC ..... *B25C 1/08* (2013.01); *B25C 5/15* (2013.01); *B25D 9/10* (2013.01); *F02B 63/02* (2013.01); *F02B 1/04* (2013.01); *F02B 19/12* (2013.01)

(58) Field of Classification Search
CPC .. B25C 1/08; B25C 5/15; B25C 1/143; B25D 9/10; F02B 36/02; F02B 1/04; F02B 19/12
See application file for complete search history.

(56) References Cited

U.S. PATENT DOCUMENTS 4,773,581 A 9/1988 Ohtsu et al.
6,863,045 B2 3/2005 Ricordi
(Continued)

FOREIGN PATENT DOCUMENTS

CN 1494989 A 5/2004
CN 1573049 A 2/2005
(Continued)

OTHER PUBLICATIONS

International Bureau, International Search Report in International Application No. PCT/EP2016/081852, dated Mar. 20, 2017.

*Primary Examiner* — Syed O Hasan
(74) *Attorney, Agent, or Firm* — Leydig Voit & Mayer, Ltd

(57) ABSTRACT

A combustion-powered placing tool for driving fastening elements into a subsurface comprises a main combustion chamber for a compressible fuel, a driving piston, which in a starting position is retracted, and which can be driven from the main combustion chamber in the placing direction via expandable gases, a prechamber to which an ignition device is assigned, and in which a pressure acting upon the main combustion chamber can be build up prior to ignition of a fuel-air mixture in the main combustion chamber, wherein an additional ignition device is assigned to the main combustion chamber. In order to improve the effectiveness and/or the functionality during driving-in of a fastener, the placing tool comprises a selector device, allowing a selection between a reduced energy operation having an ignition
(Continued)

in the main combustion chamber and a high-energy operation having an ignition in the prechamber.

20 Claims, 4 Drawing Sheets

(51) Int. Cl.

| | |
|---|---|
| ***B25C 5/15*** | (2006.01) |
| ***B25D 9/10*** | (2006.01) |
| ***F02B 63/02*** | (2006.01) |
| *F02B 19/12* | (2006.01) |

(56) References Cited

U.S. PATENT DOCUMENTS

| | | | | |
|---|---|---|---|---|
| 7,427,007 | B2 | 9/2008 | Shima et al. | |
| 9,604,352 | B2 | 3/2017 | Kobayashi et al. | |
| 9,739,217 | B2 | 8/2017 | Burkhardt et al. | |
| 2004/0079302 | A1* | 4/2004 | Wolf | B25C 1/08 123/46 R |
| 2004/0182336 | A1 | 9/2004 | Ohmori et al. | |
| 2005/0035171 | A1 | 2/2005 | Ohtsu et al. | |
| 2005/0229598 | A1 | 10/2005 | Akiba et al. | |
| 2007/0000458 | A1 | 1/2007 | Neumann et al. | |
| 2008/0217372 | A1* | 9/2008 | Webb | B25C 1/008 227/10 |
| 2008/0251558 | A1* | 10/2008 | Suda | B25F 5/00 227/2 |
| 2010/0079624 | A1* | 4/2010 | Miyasako | G06T 7/215 348/241 |
| 2010/0176177 | A1 | 7/2010 | Hiroshi | |
| 2010/0187280 | A1 | 7/2010 | Akiba et al. | |
| 2010/0237126 | A1* | 9/2010 | Matsunaga | B25C 1/008 227/8 |
| 2012/0118932 | A1 | 5/2012 | Largo et al. | |
| 2012/0153002 | A1 | 6/2012 | Dittrich | |
| 2014/0299646 | A1 | 10/2014 | Webb | |

FOREIGN PATENT DOCUMENTS

| | | | |
|---|---|---|---|
| CN | 103659727 | A | 3/2014 |
| DE | 40 10 517 | A1 | 10/1991 |
| DE | 42 43 617 | A1 | 6/1994 |
| DE | 102 32 035 | A1 | 1/2004 |
| EP | 1 388 394 | A1 | 2/2004 |
| EP | 1 712 334 | A1 | 10/2006 |
| EP | 2 050 542 | A1 | 4/2009 |
| EP | 2 465 643 | A2 | 6/2012 |
| JP | 2014-528365 | A | 10/2014 |
| TW | 200426002 | A | 12/2004 |
| TW | 200524714 | A | 8/2005 |
| TW | 200603961 | A | 2/2006 |
| TW | 200823019 | A | 6/2008 |
| TW | 201026455 | A | 7/2010 |
| TW | 201119805 | A | 6/2011 |
| WO | WO 2008/018377 | A1 | 2/2008 |
| WO | WO 2008/029687 | A1 | 3/2008 |
| WO | WO 2008/118838 | A1 | 10/2008 |
| WO | WO 2009/014862 | A1 | 1/2009 |
| WO | WO 2011/028721 | A1 | 3/2011 |
| WO | WO 2015/022383 | A1 | 2/2015 |
| WO | WO 2017/108751 | A1 | 6/2017 |
| WO | WO 2017/108777 | A1 | 6/2017 |
| WO | WO 2017/108786 | A1 | 6/2017 |

* cited by examiner

COMBUSTION-POWERED PLACING TOOL AND METHOD FOR OPERATING SUCH A PLACING TOOL

CROSS-REFERENCE TO RELATED APPLICATIONS

This patent application is the U.S. National Stage of International Patent Application No. PCT/EP2016/081852, filed Dec. 20, 2016, which claims the benefit of European Patent Application No. 15201888.3, filed Dec. 22, 2015, which are each incorporated by reference.

TECHNICAL FIELD

The invention relates to a combustion-powered setting tool for driving fastening elements into a substrate, with at least one main combustion chamber for a fuel, with a driving piston that is completely retracted in an initial position and can be driven by means of expandable gases out of the main combustion chamber in the setting direction, and with a prechamber with which an ignition device is associated and in which, prior to the ignition of a fuel/air mixture in the main combustion chamber, a pressure acting on the main combustion chamber can be built up, with an additional ignition device being associated with the main combustion chamber. The invention further relates to a method for operating such a combustion-powered setting tool.

BACKGROUND OF THE INVENTION

German published patent application DE 42 43 36 17 A1 describes a portable, combustion-powered implement, particularly a setting tool for fastening elements, with a cylindrical combustion chamber for combusting an air/fuel mixture, whereby a tappet that is guided through the combustion chamber cylinder can be driven, with a prechamber communicating with the undersurface of the piston that is facing away from the combustion chamber being provided in which, in order to compress the air/fuel mixture in the combustion chamber, an ignition-induced combustion process of an air/fuel mixture can be triggered.

BRIEF SUMMARY OF THE INVENTION

It is the object of the invention to improve the effectiveness and/or the functionality during the driving-in of fastening elements using a combustion-powered setting tool with a driving piston that is completely retracted in an initial position and can be driven by means of expandable gases out of the main combustion chamber in the setting direction, and with a prechamber with which an ignition device is associated and in which, prior to the ignition of a fuel/air mixture in the main combustion chamber, a pressure acting on the main combustion chamber can be built up, with an additional ignition device being associated with the main combustion chamber.

The object is achieved in a combustion-powered setting tool for driving fastening elements into a substrate, with at least one main combustion chamber for a compressible fuel, with a driving piston that is completely retracted in an initial position and can be driven by means of expandable gases out of the main combustion chamber in the setting direction, and with a prechamber with which an ignition device is associated and in which, prior to the ignition of a fuel/air mixture in the main combustion chamber, a pressure acting on the main combustion chamber can be built up, with an additional ignition device being associated with the main combustion chamber, by virtue of the fact that the setting tool comprises a selector device by means of which a selection can be made between a low-power mode with an ignition in the main combustion chamber and a high-power mode with an ignition in the prechamber. Through the combination of the two ignition devices with the selector device, the driving piston of the setting tool can accelerated out of its initial position either with relatively little power in low-power mode or with a relatively large amount of power in high-power mode. This substantially simplifies the operation of the combustion-powered setting tool while securing fastening elements in various types of substrate. When in its initial position, the driving piston is located at rear dead center, so to speak.

A preferred embodiment of the combustion-powered setting tool is characterized in that the setting tool comprises a control device that is connected to at least one sensor device for detecting the pressure, temperature, and/or position in or near the prechamber and/or with at least one sensor device in or near the main combustion chamber. After an ignition of a gas mixture in the prechamber, a subsequent ignition in the main combustion chamber can be controlled in a very precise and effective manner with the aid of the control device and the sensor device or sensor devices.

Another preferred exemplary embodiment of the combustion-powered setting tool is characterized in that the setting tool comprises a reset device that is connected for control to the ignition device of the main combustion chamber/prechamber in order to effect a resetting of the driving piston into its initial position in the event of a piston fault as a result of an ignition in the main combustion chamber/prechamber. In the event of a piston fault, the driving piston is not automatically returned to its initial position. If an operator of the setting tool identifies such a piston fault, the operator can easily initiate the return of the driving piston to its initial position using the reset device. Depending on the design of the setting tool, the fault can also be identified automatically—by means of commensurate position detection, for example. The returning of the driving piston to its initial position can then also be brought about automatically via the reset device.

Another preferred exemplary embodiment of the combustion-powered setting tool is characterized in that the setting tool comprises an actuator with which a target value of a pressure, temperature, position, and/or time control can be set or adjusted manually. In this way, a setting operation with the setting tool can be influenced individually. Alternatively or in addition, the target value of the pressure, temperature, position, and/or time control can be set automatically by means of the control device, for example by evaluating a previous placement.

Another preferred exemplary embodiment of the combustion-powered setting tool is characterized in that, in addition to the low-power mode and the high-power mode, the setting tool has at least one other operating mode in which a piston fault is detected and/or eliminated. The piston fault can be recognized by an operator and eliminated by actuating the reset device. However, the piston fault can also be detected automatically—by means of appropriate position detection, for example—and then eliminated through actuation of the reset device. It is also possible, for example, for the piston fault to be detected automatically and eliminated automatically by means of the reset device.

Another preferred exemplary embodiment of the combustion-powered setting tool is characterized in that, in addition to the low-power mode and the high-power mode, the setting tool has at least one other operating mode in which a gas mixture is first ignited by the ignition device of the prechamber, and then the gas mixture is ignited in the main combustion chamber in a time-, pressure-, position-, and/or temperature-controlled manner by the additional ignition device. For example, a defined system pressure is built up in the main combustion chamber and, at a certain point in time, the main combustion chamber is ignited by the additional ignition device. For time-controlled ignition, a defined offset is selected between the prechamber ignition and the main combustion chamber ignition, for example. In the case of a pressure-controlled ignition, the pressure in the prechamber or in the main combustion chamber is advantageously measured with the aid of the respectively associated sensor device. The main combustion chamber is then ignited with the additional ignition device as soon as a certain pressure level is reached. In the case of position-controlled ignition, a propagation path of a flame is measured after the prechamber ignition using thermal/optical sensors, for example. An ignition of the main combustion chamber is then advantageously triggered by the additional ignition device when the flame has traveled two-thirds of its path to the overflow openings between the prechamber and the main combustion chamber, for example. Alternatively or in addition, a travel of a slide and/or of the driving piston or a force that acts on the slide can be measured.

Another preferred exemplary embodiment of the combustion-powered setting tool is characterized in that an air bleed valve device is associated with the main combustion chamber that makes pressure equalization with the surroundings possible in the event of a piston fault during a secondary ignition in the main combustion chamber. After a primary ignition in the main combustion chamber, a piston fault can occur. This piston fault is eliminated by the secondary ignition in the main combustion chamber. During the secondary ignition in the main combustion chamber, pressure equalization with the surroundings is performed by means of the air bleed valve device. The air bleed valve device is then closed. During the subsequent cooking of the combustion gases in the main combustion chamber, the driving piston is pulled back into its initial position by the negative pressure that is formed in the main combustion chamber. The air bleed valve device is closed during normal operation.

The prechamber of the previously described setting tool is or can be preferably connected by at least one passage opening, which can be sealed by a control device, to surroundings of the prechamber, with the control device being advantageously connected for pressure control to the main combustion chamber.

Alternatively or in addition, the abovementioned object is achieved by a method for operating a combustion-powered setting tool as described above. During high-power mode, the setting tool can be operated with a precombustion and a subsequent main combustion in the main combustion chamber. In low-power mode as well, however—which corresponds to normal, conventional operation—the setting tool can also be operated with combustion only in the main combustion chamber without precombustion with the aid of the additional ignition device. Moreover, in the above-described setting tool, the driving piston can be easily returned to its initial position in the event of an undesired piston fault. The power of the setting tool can be easily varied through appropriate setting of the system pressure. The system pressure is set in a time-, position-, temperature-, or pressure-controlled manner, for example.

One preferred exemplary embodiment of the method is characterized in that the piston fault is detected automatically, particularly through piston position detection, and an ignition is initiated in the prechamber or in the main combustion chamber in order to return the driving piston to its initial position. This simplifies the operation of the setting tool substantially. The return of the driving piston to its initial position can be initiated automatically or manually.

Another preferred exemplary embodiment of the method is characterized in that the main combustion chamber is flushed in the event of a piston fault, after which the driving piston is returned to its initial position by means of an ignition in the main combustion chamber achieved by a placement in low-power mode. The returning of the driving piston to its initial position is advantageously performed thermally if negative pressure occurs in the main combustion chamber during cooling after the secondary ignition.

As applicable, the invention also relates to a computer program product with a program code for carrying out the method described above, particularly if the program is carried out in the control unit of the setting tool.

BRIEF DESCRIPTION OF THE SEVERAL VIEWS OF THE DRAWING(S)

Additional advantages, features and details of the invention follow from the following description, in which various exemplary embodiments are described in detail with reference to the drawing.

DETAILED DESCRIPTION OF THE INVENTION

Figure 1:
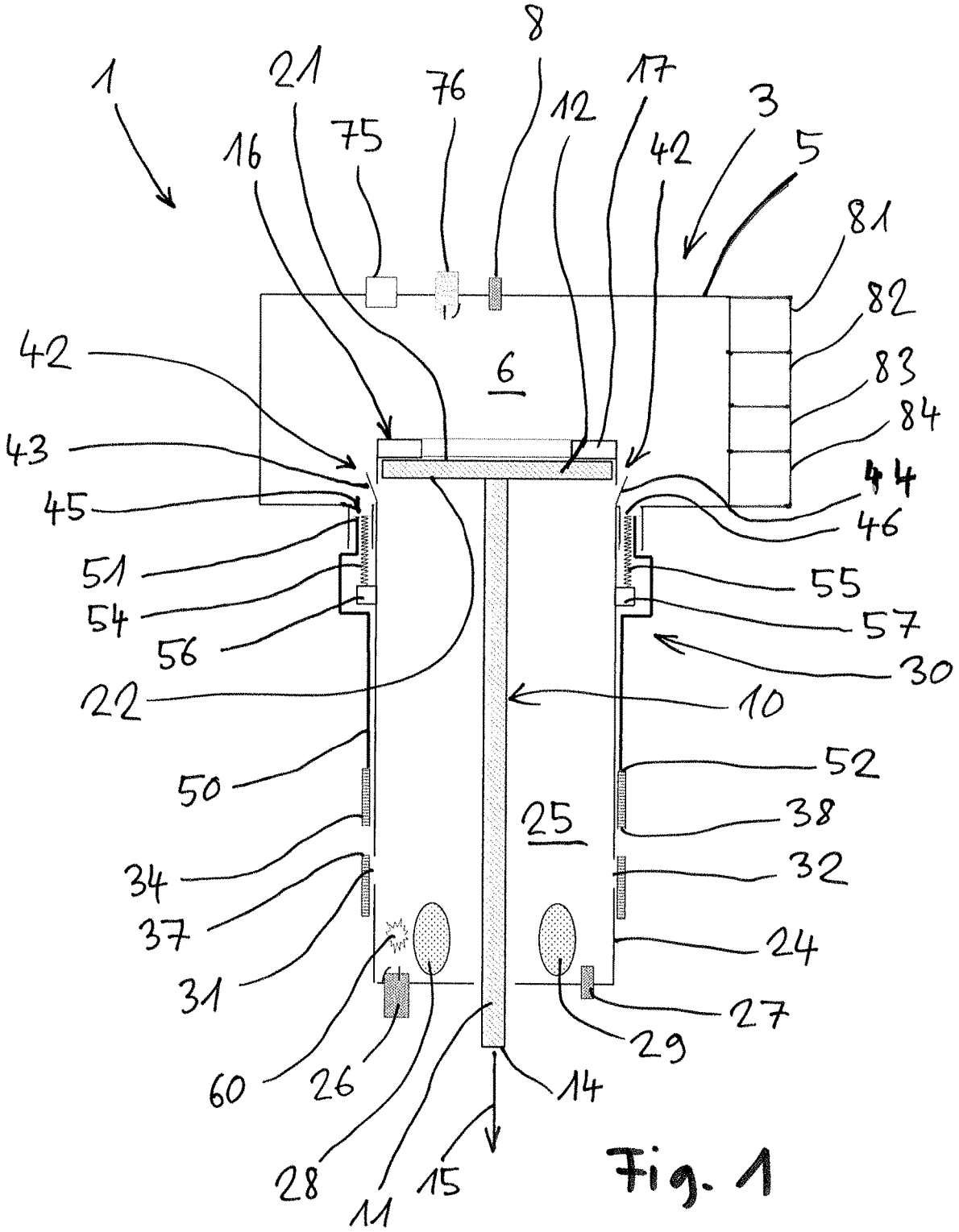
FIG. 1 shows a simplified cross-sectional representation of a combustion-powered setting tool in a longitudinal section shortly after an ignition in a prechamber in a high-power mode.
Figure 2:
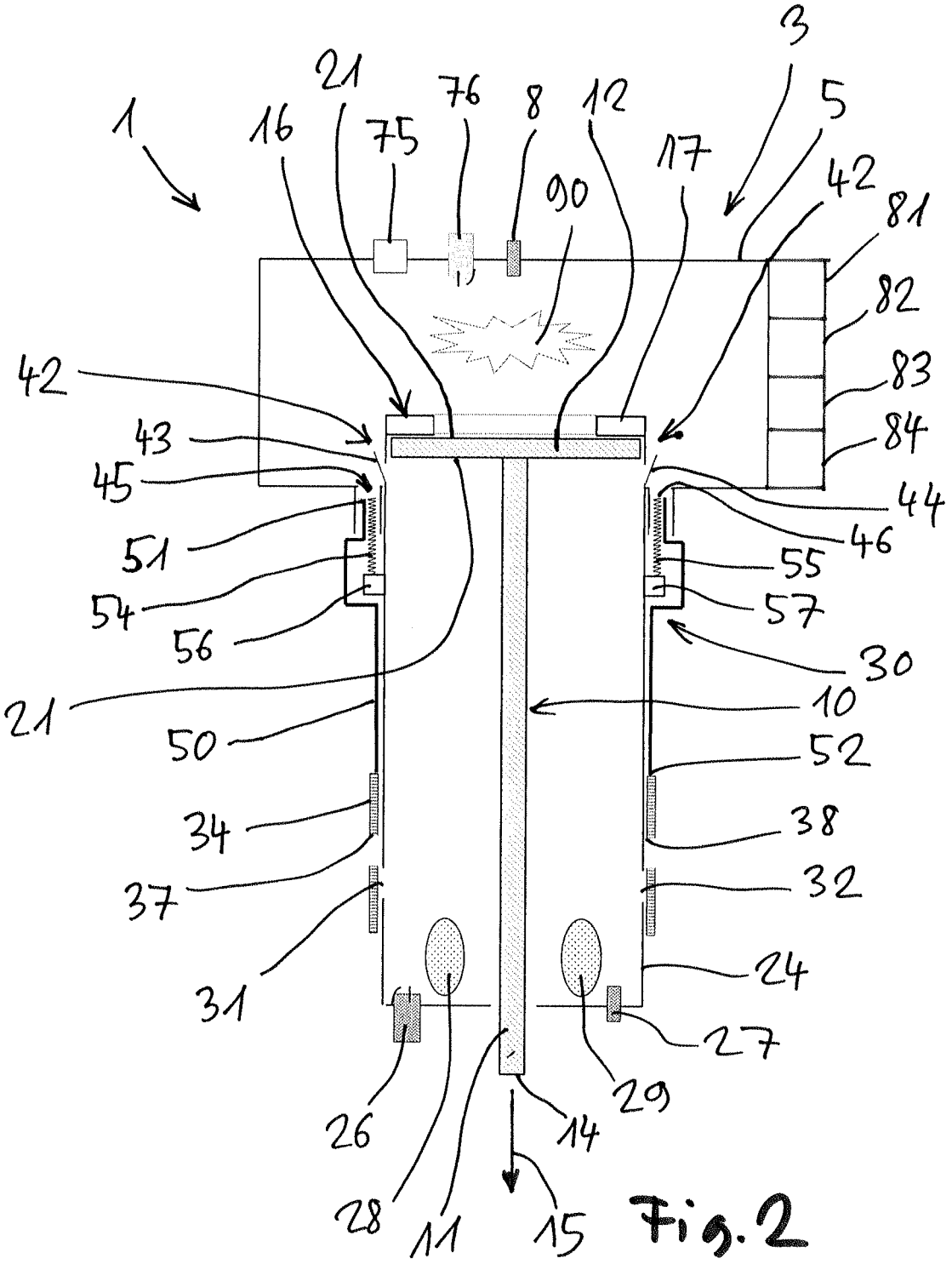
FIG. 2 shows the setting tool from FIG. 1 in a low-power mode shortly after an ignition in a main combustion chamber.
Figure 4:
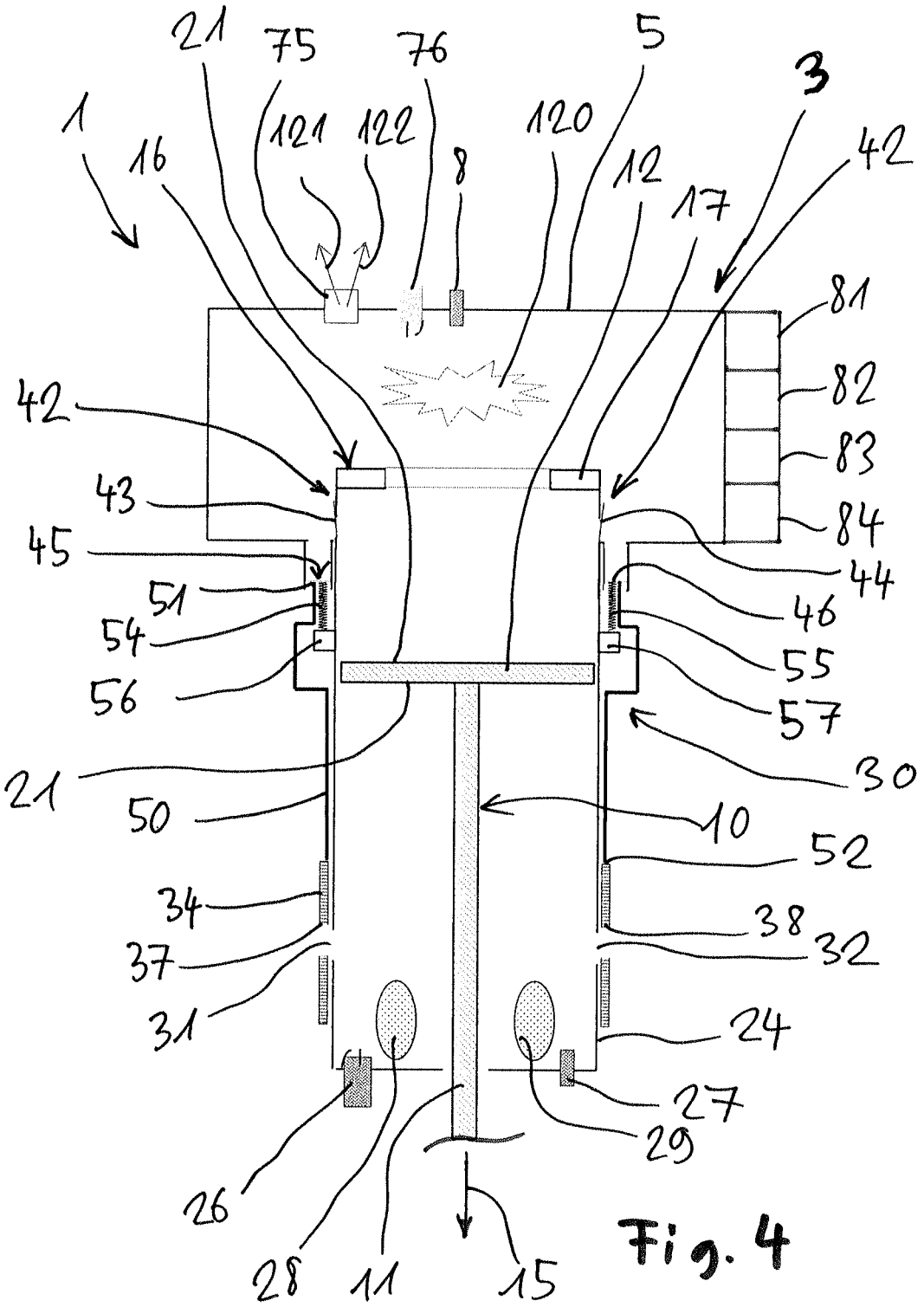
FIG. 4 shows the setting tool from FIGS. 1 and 2 in the case of piston fault and subsequent ignition of a main combustion chamber.

FIGS. 1, 2 and 4 shows a highly simplified representation in longitudinal section of a setting tool 1 in various operating states. The setting tool 1 illustrated in FIGS. 1, 2 and 4 can be operated with a fuel gas or with a vaporizable liquid fuel. The setting tool 1 comprises a housing 3 with a main cylinder 5 that defines a main combustion chamber 6. The main combustion chamber 6 can be supplied with gas and/or air via an inlet device 8.

In FIGS. 1, 2 and 4, a driving piston 10 is guided upward and downward in the housing 3 of the setting tool 1 so as to be displaceable back and forth. The driving piston 10 comprises a piston rod 11 that extends from a piston head 12. A setting end 14 of the piston rod 11 facing away from the piston head 12 is arranged in a bolt guide (not shown) that has the function of guiding fastening elements, also referred to as bolts. In FIG. 4 shows a cutaway view of the setting end 14 of the piston rod 11 of the driving piston 10.

The bolt guide with the piston rod 11 of the driving piston 10 arranged therein is also called a setting unit. A fastening element such as a nail, bolt, or the like, can be driven into a substrate (not shown) using the setting unit. Before a fastening element is set, the setting tool 1 is pressed with its bolt guide against the substrate. A switch (not shown), which is also referred to as a trigger switch, is used to initiate the setting process, for example. The switch is provided on a handle (also not shown) of the setting tool 1, for example.

In FIGS. 1, 2 and 4, a setting direction is indicated by an arrow 15. During the setting of the fastening element, the driving piston 10 is powerfully accelerated with the piston rod 11 in the setting direction 15 in order to drive the fastening element into the substrate. During the setting process, the driving piston 10 is moved from its initial position as shown in FIGS. 1 and 2, which corresponds to a top dead center, into an end position, which corresponds to a bottom dead center.

In FIGS. 1, 2 and 4, an upward movement of the driving piston 10 is limited by a piston stop 16 that is securely fixed to the housing. Top dead center of the driving piston 10 is defined by the piston stop 16. The piston stop 16 can be combined with a magnetic device 17. The magnetic device 17 serves the purpose, for example, of holding the driving piston 10 with a predetermined retention force in its initial position as shown in FIGS. 1 and 2.

A movement of the driving piston 10 downward is limited by one or more stop and/or damping elements 28, 29. The stop and/or damping elements 28 are embodied as buffers, for example.

The piston head 12 comprises a first piston surface 21, which faces toward the main combustion chamber 6. A second piston surface 22, which faces away from the main combustion chamber 6, defines a prechamber 25 in a prechamber cylinder 24. The prechamber cylinder 24 is arranged within the housing 3 of the setting tool 1.

The prechamber 25 constitutes a precombustion chamber with which an ignition device 26 and an inlet device 27 are associated. Moreover, the stop and/or damping elements 28, 29 are arranged in the prechamber 25. Air or a fuel gas/air mixture is fed via the inlet device 27 to the prechamber or precombustion chamber 25 and is ignited with the aid of the ignition device 26 in the prechamber 25, as indicated by a symbol 60 in FIG. 1.

The prechamber cylinder 24 comprises two passage openings 31, 32, which enable exhaust gases to escape from the prechamber 25, for example. The passage openings 31, 32 can be sealed as needed by a control device 30. The control device 30 comprises a control sleeve 34 that has two passage openings 37, 38.

When the passage openings 37, 38 of the control sleeve 34 are caused to overlap with the passage openings 31, 32, then the passage openings 31, 32 are opened, as can be seen in FIG. 4. In FIGS. 1 and 2, the passage openings 31, 32 are sealed by the control sleeve 34. The control sleeve 34 has substantially the shape of a straight, regular cylinder and can be moved downward and upward in FIGS. 1, 2 and 4.

Two overflow openings 41, 42 are provided between the prechamber 25 and the main combustion chamber 6. A valve device 43, 44 is associated with the overflow openings 41, 42, respectively. The valve devices 43, 44 are valve flaps, for example, that are opened in FIGS. 1 and 2 in order enable the ignited air/fuel mixture to flow through from the prechamber 25 into the main combustion chamber 6. In FIG. 4, the valve devices 43, 44 are closed.

The control device 30 comprises a control pressure surface 45 that is connected for pressure control to the main combustion chamber 6. The control pressure surface 45 is embodied as a ring-shaped surface 46 that faces toward the main combustion chamber 6 radially outside of the prechamber cylinder 24. The control pressure surface 45 is coupled mechanically by means of a coupling element with the control sleeve 34.

The coupling element is embodied as a slide 50 which, in FIGS. 1, 2 and 4, is guided so as to be displaceable downward and upward back and forth against the prechamber cylinder 24. In FIGS. 1, 2 and 4, the control pressure surface 45 that is embodied as a ring-shaped surface 46 is provided at an upper end 51 of the slide 50. In FIGS. 1, 2 and 4, the control sleeve 34 is secured to a lower end 52 of the slide 50.

The control device 30 further comprises spring means 54, 55 that are embodied as helical compression springs, for example. In FIGS. 1, 2 and 4, a respective stop 56, 57 that is securely fixed to the cylinder is associated with the lower ends of the spring means 54, 55. The stops 56, 57 that are securely fixed to the housing are provided on the prechamber cylinder 24.

The spring means 54, 55 are braced between the stops 56, 57 that are securely fixed to the cylinder and the upper end 51 of the slide 50 with the control pressure surface 45. The slide 50 is thus supported by means of the spring means 54, 55 on the stops 56, 57 that are securely fixed to the cylinder.

In FIG. 1, the setting tool 1 is shown shortly after the ignition 60 in the prechamber 25. The ignited mixture travels via the opened valve devices 43, 44 through the overflow openings 41, 42 into the main combustion chamber 6. The passage openings 31, 32 of the prechamber 25 are sealed by the control sleeve 34.

Figure 3:
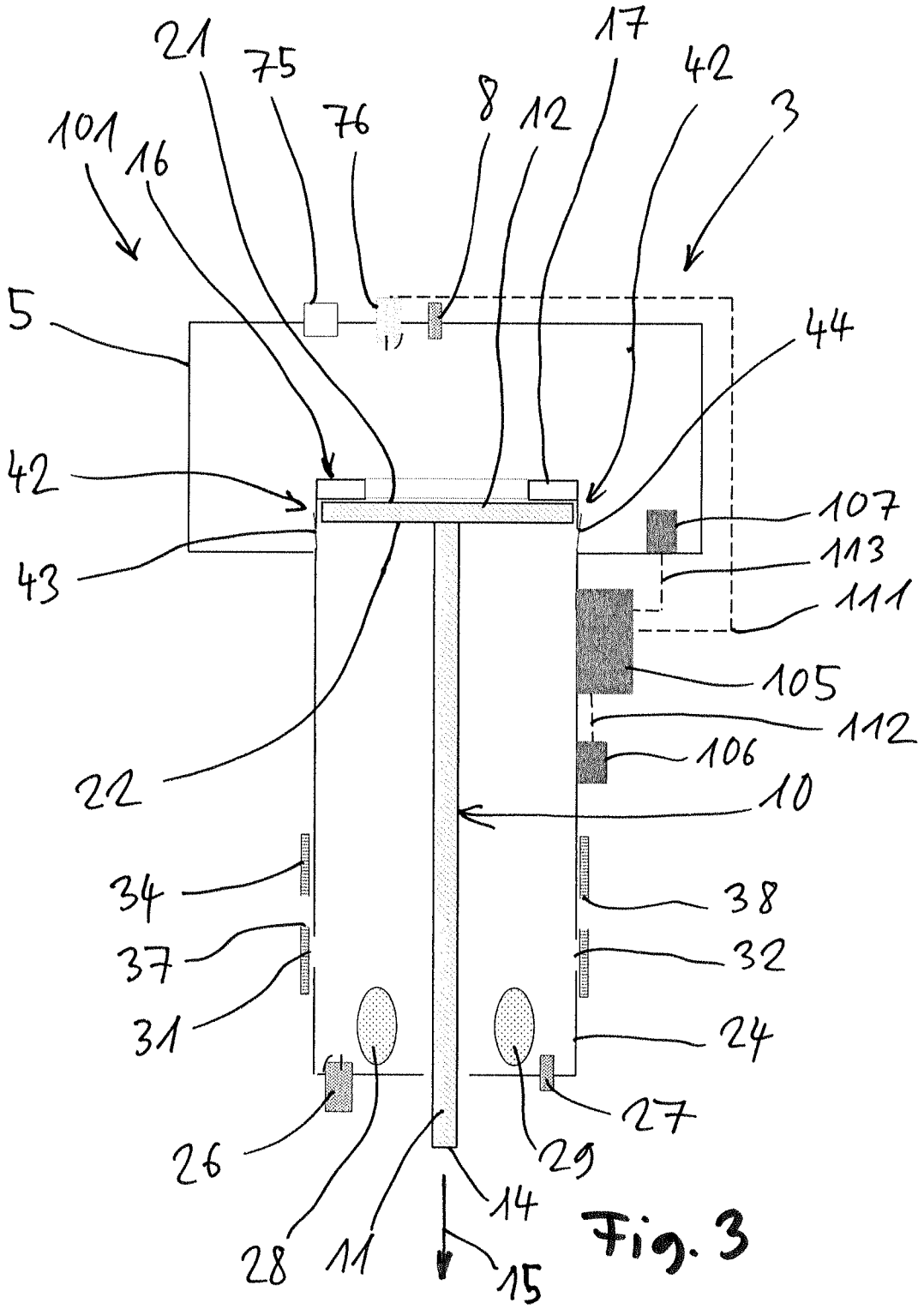
FIG. 3 shows a setting tool that is similar to that in FIGS. 1 and 2 with an electrical control device that is connected to sensor devices.

In FIGS. 1 to 3, the driving piston 10 is located in its initial or starting position at rear dead center. In this initial or starting position, the driving piston 10 is retracted completely into the housing 3. In the initial position or starting position, the piston head 12 of the driving piston 10 abuts against the piston stop 16 that is securely fixed to the cylinder.

The setting tool 1; 101 shown in FIGS. 1 to 4 can be operated in various operating modes or functional modes. In a high-power mode, a gas mixture, particularly a fuel/air mixture, is metered both into the prechamber 25 and into the main combustion chamber 6. A first ignition occurs as a result of the ignition device 26 in the prechamber 25.

In FIGS. 1, 2 and 4, a selector device, a control device, a reset device, and an actuator are indicated symbolically by a total of four rectangles 81 to 84. Using the selector device 81, it is possible to switch between the different operating modes of the setting tool 1. The control device 82 can be provided alternatively or in addition to the control device 30. The control device 82 preferably also has the function of presenting the various operating modes of the setting tool 1. The reset device 83 advantageously serves the purpose of initiating the elimination of a piston fault of the setting tool 1 as needed. The actuator 84 is advantageously used to manually set and/or adjust a target value of a pressure, temperature, position, and/or time control.

In FIG. 1, the ignition in the prechamber 25 is indicated by a symbol 60. The combustion then propagates in the direction of the main combustion chamber 6 and ignites same through the valve devices 43, 44, which are embodied as check valves.

It is shown in FIG. 2 that, in a low-power mode of the setting tool 1, injection and ignition occur only in the main combustion chamber 6. The ignition in the main combustion chamber 6 occurs by means of the additional ignition device 76, as is indicated by a symbol 90.

In low-power mode, it is possible to adjust, particularly reduce, the spring bias of the spring means 54, 55. By reducing the spring bias, the driving piston 10 can be easily prevented from running onto a gas cushion in low-power mode. The spring bias can be adjusted, for example, by means of a screw thread between the stops 56, 57 that are securely fixed to the housing and the prechamber cylinder 24.

In FIG. 3, a setting tool 101 is shown with a control device 105, which replaces the control devices 30, 82 in FIGS. 1, 2 and 4. The setting tool 101 further comprises a sensor device 106, which is associated with the prechamber 25. Moreover, the setting tool 101 comprises a sensor device 107, which is associated with the main combustion chamber 6.

The control device 105 is connected by a control line 111 to the additional ignition device 76. Moreover, the control device 105 is connected by a control line 112 to the sensor device 106. Furthermore, the control device 105 is connected by a control line 113 to the sensor device 107.

The sensor devices 106, 107 are position, time, pressure, or temperature sensors. The control device 105 is preferably an electronic control. Starting at a predetermined target value that is adjusted via the control device 105, the ignition occurs in the main combustion chamber 6 by means of the ignition device 76 located therein, which is embodied as a spark plug, for example. The target value can either be set by a user or automatically—based on the evaluation of a previous setting operation, for example.

During operation of the setting tool 101, a defined system pressure is first built up in the main combustion chamber 6 by the prechamber combustion. Then the ignition device 76 is ignited by means of the control device 105 at the defined point in time. In the case of a pressure-controlled ignition, the pressure is measured by the sensor device 106 in the prechamber 25 and/or by the sensor device 107 in the main combustion chamber 6. The main combustion chamber 6 is then ignited starting at a certain pressure level.

FIG. 4 shows the setting tool 1 from FIGS. 1 and 2 with a piston fault. The driving piston is shown with its end facing away from the piston head 12 cut away. The piston head 12 of the driving piston 10 is arranged somewhat below the stops 56, 57 that are securely fixed to the housing. With the aid of the additional ignition device 76 of the main combustion chamber 6, the piston fault can be eliminated according to different variants.

According to a first variant, the driving piston 10 is returned after an additional ignition cycle in the main combustion chamber 6 to its original or initial position. The valve device 75 is used to vent the main combustion chamber 6. A symbol 120 denotes a secondary ignition in the main combustion chamber 6 that is initiated by the additional ignition device 76.

The arrows 121,122 indicate that pressure equalization is being performed between the main combustion chamber 6 and the surroundings via the opened valve device 75. When the valve device 75 is closed, this results in the formation of negative pressure in the main combustion chamber 6, so final cooling of the combustion gases in the main combustion chamber 6 has the effect of the driving piston 10 in FIG. 4 being pulled upward and back into its initial position. During normal operation, the valve device 75 is closed.

The elimination of the piston fault is initiated by actuation of the reset device 83, for example. When the reset device 83 is actuated, the additional ignition or secondary ignition 120 of the main combustion chamber 6 is initiated. If the residual gas fraction in the main combustion chamber 6 is too great, the valve device 75 of the main combustion chamber 6 is advantageously opened in order to enable flushing of the main combustion chamber 6.

If normal device flushing due to a piston fault does not work, it is possible to flush the main combustion chamber 6 and feed fresh air in by opening the valve device 75. After fuel is introduced, the main combustion chamber 6 can then be ignited by means of the additional ignition device 76. A setting operation that is brought about in this way occurs in low-power mode. After the setting operation in low-power mode, the driving piston is again returned by thermal means, so that the setting tool 1 can then be used again in high-power mode.

The invention claimed is:

1. A combustion-powered setting tool for driving fastening elements into a substrate, the tool comprising at least one main combustion chamber for a fuel; a driving piston that is completely retracted in an initial position and can be driven by expandable gases out of the at least one main combustion chamber in a setting direction in a low-power mode and a high-power mode; a prechamber; an ignition device, wherein the ignition device is associated with the prechamber and in the prechamber, prior to the ignition of a fuel/air mixture in the at least one main combustion chamber, a pressure acting on the at least one main combustion chamber is built up in the high power mode; an additional ignition device, wherein the additional ignition device is associated with the at least one main combustion chamber, and in the at least one main combustion chamber, a fuel/air mixture is ignited without prior ignition in the prechamber in the low power mode; and a selector device by which a selection is made between the low-power mode and the high-power mode.

2. The combustion-powered setting tool as set forth in claim 1, wherein the setting tool comprises a control device that is connected to at least one sensor device for detecting the pressure, temperature, and/or position in or near the prechamber and/or connected to at least one sensor device in or near the at least one main combustion chamber.

3. The combustion-powered setting tool as set forth in claim 1, wherein the setting tool comprises a reset device that is connected for control to the ignition device of the at least one main combustion chamber and/or the prechamber in order to effect a resetting of the driving piston into the initial position of the driving piston in the event of a piston fault as a result of an ignition in the at least one main combustion chamber and/or the prechamber.

4. The combustion-powered setting tool as set forth in claim 1, wherein the setting tool comprises an actuator with which a target value of a pressure, temperature, position, and/or time control can be set or adjusted manually.

5. The combustion-powered setting tool as set forth in claim 1, wherein, in addition to the low-power mode and the high-power mode, the setting tool has at least one other operating mode in which a piston fault is detected and/or eliminated.

6. The combustion-powered setting tool as set forth in claim 1, wherein, in addition to the low-power mode and the high-power mode, the setting tool has at least one other operating mode in which a gas mixture is first ignited by the ignition device of the prechamber, and then the gas mixture is ignited in the at least one main combustion chamber by the additional ignition device based on time, pressure, position, and/or temperature control.

7. The combustion-powered setting tool as set forth in claim 2, wherein the setting tool comprises a reset device that is connected for control to the ignition device of the at least one main combustion chamber and/or the prechamber in order to effect a resetting of the driving piston into the initial position of the driving piston in the event of a piston fault as a result of an ignition in the at least one main combustion chamber and/or the prechamber.

8. The combustion-powered setting tool as set forth in claim 2, wherein the setting tool comprises an actuator with which a target value of a pressure, temperature, position, and/or time control can be set or adjusted manually.

9. The combustion-powered setting tool as set forth in claim 3, wherein the setting tool comprises an actuator with which a target value of a pressure, temperature, position, and/or time control can be set or adjusted manually.

10. The combustion-powered setting tool as set forth in claim 2, wherein, in addition to the low-power mode and the high-power mode, the setting tool has at least one other operating mode in which a piston fault is detected and/or eliminated.

11. The combustion-powered setting tool as set forth in claim 3, wherein, in addition to the low-power mode and the high-power mode, the setting tool has at least one other operating mode in which a piston fault is detected and/or eliminated.

12. The combustion-powered setting tool as set forth in claim 4, wherein, in addition to the low-power mode and the high-power mode, the setting tool has at least one other operating mode in which a piston fault is detected and/or eliminated.

13. The combustion-powered setting tool as set forth in claim 2, wherein, in addition to the low-power mode and the high-power mode, the setting tool has at least one other operating mode in which a gas mixture is first ignited by the ignition device of the prechamber, and then the gas mixture is ignited in the at least one main combustion chamber by the additional ignition device based on time, pressure, position, and/or temperature control.

14. The combustion-powered setting tool as set forth in claim 3, wherein, in addition to the low-power mode and the high-power mode, the setting tool has at least one other operating mode in which a gas mixture is first ignited by the ignition device of the prechamber, and then the gas mixture is ignited in the at least one main combustion chamber by the additional ignition device based on time, pressure, position, and/or temperature control.

15. A combustion-powered setting tool for driving fastening elements into a substrate, the combustion-powered setting tool comprising at least one main combustion chamber for a fuel; a driving piston that is completely retracted in an initial position and can be driven by expandable gases out of the at least one main combustion chamber in a setting direction; a prechamber; an ignition device, wherein the ignition device is associated with the prechamber and in the prechamber, prior to the ignition of a fuel/air mixture in the at least one main combustion chamber, a pressure acting on the at least one main combustion chamber can be built up; an additional ignition device, wherein the additional ignition device is associated with the at least one main combustion chamber; and an air bleed valve device associated with the at least one main combustion chamber, wherein the air bleed valve device is capable of equalizing pressure with a surrounding of the setting tool if there is a piston fault during a secondary ignition in the at least one main combustion chamber.

16. A method for operating a combustion-powered setting tool for driving fastening elements into a substrate, the combustion-powered setting tool comprising at least one main combustion chamber for a fuel; a driving piston that is completely retracted in an initial position; a prechamber; an ignition device associated with the prechamber; an additional ignition device associated with the at least one main combustion chamber;

the method comprising driving the driving piston by expandable gases out of the at least one main combustion chamber in a setting direction; selecting between a low-power mode and a high power mode; and, if the high-power mode is selected, building up a pressure in the prechamber, prior to the ignition of a fuel/air mixture in the at least one main combustion chamber, acting on the at least one main combustion chamber; and, if the low-power mode is selected, igniting a fuel/air mixture in the at least one main combustion chamber without prior ignition in the prechamber.

17. The method as set forth in claim 16, wherein a piston fault is detected automatically, and an ignition is initiated in the prechamber or in the at least one main combustion chamber to return the driving piston to the driving piston's initial position.

18. The method as set forth in claim 16, wherein the main combustion chamber is flushed if there is a piston fault, after which the driving piston is returned to the driving piston's initial position by an ignition in the at least one main combustion chamber achieved in low-power mode.

19. The method of claim 17, comprising detecting the piston fault by detecting piston position.

20. The method as set forth in claim 17, wherein the main combustion chamber is flushed if there is a piston fault, after which the driving piston is returned to the driving piston's initial position by an ignition in the at least one main combustion chamber achieved in low-power mode.

* * * * *